US007777727B2

(12) United States Patent
Cha et al.

(10) Patent No.: US 7,777,727 B2
(45) Date of Patent: Aug. 17, 2010

(54) TOUCH DETECTABLE DISPLAY DEVICE

(75) Inventors: Young-Ok Cha, Gwangmyeong-si (KR); Joo-Hyung Lee, Gwacheon-si (KR); Jong-Woung Park, Seongnam-si (KR); Kee-Han Uh, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1273 days.

(21) Appl. No.: 11/315,541

(22) Filed: Dec. 21, 2005

(65) Prior Publication Data

US 2006/0146035 A1 Jul. 6, 2006

(30) Foreign Application Priority Data

Dec. 23, 2004 (KR) ..... 10-2004-0111074

(51) Int. Cl.
*G09G 5/00* (2006.01)

(52) U.S. Cl. ..... 345/173

(58) Field of Classification Search ..... 345/173, 345/175

See application file for complete search history.

(56) References Cited

U.S. PATENT DOCUMENTS

| | | | | |
|---|---|---|---|---|
| 5,589,856 | A * | 12/1996 | Stein et al. | 345/173 |
| 6,295,052 | B1 | 9/2001 | Kato et al. | |
| 6,415,138 | B2 * | 7/2002 | Sirola et al. | 455/90.1 |
| 6,707,449 | B2 * | 3/2004 | Hinckley et al. | 345/173 |
| 6,775,560 | B2 | 8/2004 | King et al. | |
| 6,785,562 | B2 | 8/2004 | Lee et al. | |
| 7,489,305 | B2 * | 2/2009 | Salisbury et al. | 345/173 |
| 2004/0067770 | A1 | 4/2004 | King et al. | |
| 2004/0204126 | A1 | 10/2004 | Reyes et al. | |
| 2005/0114825 | A1 * | 5/2005 | Leung et al. | 717/100 |
| 2005/0116937 | A1 * | 6/2005 | Choi et al. | 345/173 |
| 2005/0243068 | A1 * | 11/2005 | Johnson et al. | 345/173 |
| 2006/0007178 | A1 * | 1/2006 | Davis | 345/173 |
| 2007/0164923 | A1 * | 7/2007 | Kanai et al. | 345/1.1 |

FOREIGN PATENT DOCUMENTS

| | | |
|---|---|---|
| JP | 5-80314 | 4/1993 |
| JP | 8-44522 | 2/1996 |
| JP | 9-128134 | 5/1997 |
| JP | 2001-66580 | 3/2001 |
| JP | 2004-61892 | 2/2004 |
| JP | 2004-246455 | 9/2004 |

(Continued)

OTHER PUBLICATIONS

Patent Abstracts of Japan, Publication No. 05-080314, Apr. 2, 1993, 1 p.

(Continued)

*Primary Examiner*—Richard Hjerpe
*Assistant Examiner*—Tom V Sheng
(74) *Attorney, Agent, or Firm*—Innovation Counsel LLP

(57) ABSTRACT

A display device according to an embodiment of the present invention includes a display panel having a first display area and a second display area. The display panel includes: a plurality of first display circuits disposed in the first display area; a plurality of second display circuits disposed in the second display area; and a plurality of touch sensing circuits disposed in the second display area.

14 Claims, 5 Drawing Sheets

FOREIGN PATENT DOCUMENTS

| | | |
|---|---|---|
| KR | 10-1999-023365 | 3/1999 |
| KR | 10-2001-0024426 | 3/2001 |
| KR | 10-2001-0037685 | 5/2001 |
| KR | 10-2003-0032544 | 4/2003 |
| KR | 10-2003-0063638 | 7/2003 |
| KR | 10-2003-0097820 | 12/2003 |
| KR | 10-2004-0025662 | 3/2004 |

OTHER PUBLICATIONS

Patent Abstracts of Japan, Publication No. 08-044522, Feb. 16, 1996, 1 p.
Patent Abstracts of Japan, Publication No. 09-128134, May 16, 1997, 1 p.
Patent Abstracts of Japan, Publication No. 2001-066580, Mar. 16, 2001, 1 p.
Patent Abstracts of Japan, Publication No. 2004-061892, Feb. 26, 2004, 1 p.
Patent Abstracts of Japan, Publication No. 2004-246455, Sep. 2, 2004, 1 p.
English Language Abstract, Publication No. GB2328128 (Counterpart of Publication No. KR-10-1999-0023365, Mar. 25, 1999), 1 p.
English Language Abstract, Publication No. WO9918590 (Counterpart of Publication No. KR 10-2001-0024426, Mar. 26, 2001), 2 pp.
Korean Patent Abstracts, Publication No. 1020010037685, May 15, 2001, 1 p.
Korean Patent Abstracts, Publication No. 1020030032544, Apr. 26, 2003, 1 p.
Korean Patent Abstracts, Publication No. 1020030063638, Jul. 31, 2003, 1 p.
English Language Abstract, Publication No. WO02079913 (Counterpart of Publication No. KR-10-2003-0097820, Dec. 31, 2003), 1 p.
English Language Abstract, Publication No. WO03034455 (Counterpart of Publication No. KR-10-2004-0025662, Mar. 24, 2004), 2 pp.

* cited by examiner

TOUCH DETECTABLE DISPLAY DEVICE

CROSS REFERENCE TO RELATED APPLICATION

This application claims priority from Korean patent application No. 10-2004-0111074, filed Dec. 23, 2004, the contents of which are incorporated by reference herein in its entirety.

BACKGROUND OF THE INVENTION (a) Field of the Invention

The present invention relates to a display device and in particular, a touch detecting display device.

(b) Description of Related Art

A liquid crystal display (LCD) includes a pair of panels provided with pixel electrodes and a common electrode and a liquid crystal layer with dielectric anisotropy interposed between the panels. The pixel electrodes are arranged in a matrix and connected to switching elements such as thin film transistors (TFTs) such that they receive image data voltages row by row. Typically, the common electrode covers the entire surface of one of the two panels and it is supplied with a common voltage. A pixel electrode and corresponding portions of the common electrode, and corresponding portions of the liquid crystal layer form a liquid crystal capacitor that as well as a switching element connected thereto is a basic element of a pixel.

An LCD generates electric fields by applying voltages to pixel electrodes and a common electrode and varies the strength of the electric fields to adjust the transmittance of light passing through a liquid crystal layer, thereby displaying images.

Recently, an LCD incorporating photosensors has been developed. The photosensors sense the change of incident light caused by a touch of a finger or a stylus and provide electrical signals corresponding thereto for the LCD. The LCD determines whether and where a touch occurred based on the electrical signals. The LCD sends the information on the touch to an external device that may return image signals to the LCD, which are generated based on the information. Although the photosensors may be provided on an external device such as a touch screen panel to be attached to the LCD, it may increase the thickness and the weight of the LCD and it may make it difficult to represent minute characters or pictures.

A photosensor incorporated into an LCD may be implemented as a thin film transistor (TFT) disposed in a pixel displaying an image.

However, display signals and sensing signals may interfere with each other when the display operation and the sensing operation are simultaneously performed.

Furthermore, the photosensors are sensitive to characteristics of the external environment, such as luminance. For example, when the environment is dark, the sensing signals may be significantly affected by the display signals, and the magnitude of the sensing signals may be too small to determine a touched position.

Additionally, including photosensors in the display area may decrease the resolution of the pixels.

SUMMARY OF THE INVENTION

A display device according to an embodiment of the present invention includes a display panel having a first display area and a second display area. The display panel includes: a plurality of first display circuits disposed in the first display area; a plurality of second display circuits disposed in the second display area; and a plurality of touch sensing circuits disposed in the second display area.

The display panel may further include: a plurality of sensor scanning lines disposed in the second display area; and a plurality of sensor data lines disposed in the second display area, wherein the sensing circuits are connected to the sensor scanning lines and the sensor data lines.

The display panel may further include: a plurality of first image scanning lines disposed in the first display area; a plurality of second image scanning lines disposed in the second display area; a plurality of first image data Lines disposed in the first display area; and a plurality of second image data lines disposed in the second display area, wherein the first display circuits are connected to the first image scanning lines and the first image data lines, and the second display circuits are connected to the second image scanning lines and the second image data lines.

The second image data lines may extend from the first image data lines.

The display panel may include: a first panel unit having the first display area; and a second panel unit having the second display area and separated from the first panel unit.

The display device may further include a connecting member connecting the first panel unit and the second panel unit. The connecting member may include a plurality of conductive lines for electrical connection between the first panel unit and the second panel unit. The connecting member may be a flexible printed circuit film.

A resolution of the second display circuits may be different from a resolution of the photo sensing circuits.

A resolution of the second display may be different from a resolution of the first display circuits. The resolution of the second display may be higher than the resolution of the first display circuits.

Each of the sensing circuits may form a pixel along with one of the second display circuits.

The touch sensing circuits may include photo sensing circuits generating sensor output signals based on an amount of ambient light, and the image data lines may carry sensor data signals originated from the sensor output signals.

Each of the photo sensing circuits may include: a sensing element generating current having a magnitude which is a function of the amount of light; and a switching element coupled to the sensing element and selectively outputting the sensor output signals based on the current. Each of the photo sensing circuits may further include a capacitor storing the current.

The display device may further include: an image data driver converting image signals into image data signals and applying the image data signals to the first and the second image data lines; a sensing signal processor processing the sensor data signals supplied from the sensor data lines to generate digital sensor data signals; and a signal controller controlling the image data driver and the sensing signal processor.

The image data driver, the sensing signal processor, and the signal controller may be integrated into a single integrated circuit chip.

The display device may further include: an image scanning driver applying image scanning signals to the image scanning lines; and a sensor scanning driver applying sensor scanning signals to the sensor lines.

BRIEF DESCRIPTION OF THE DRAWINGS

The present invention will become more apparent from the description of the embodiments with reference to the accompanying drawing in which.

DETAILED DESCRIPTION OF THE PREFERRED EMBODIMENTS

Figure 1:
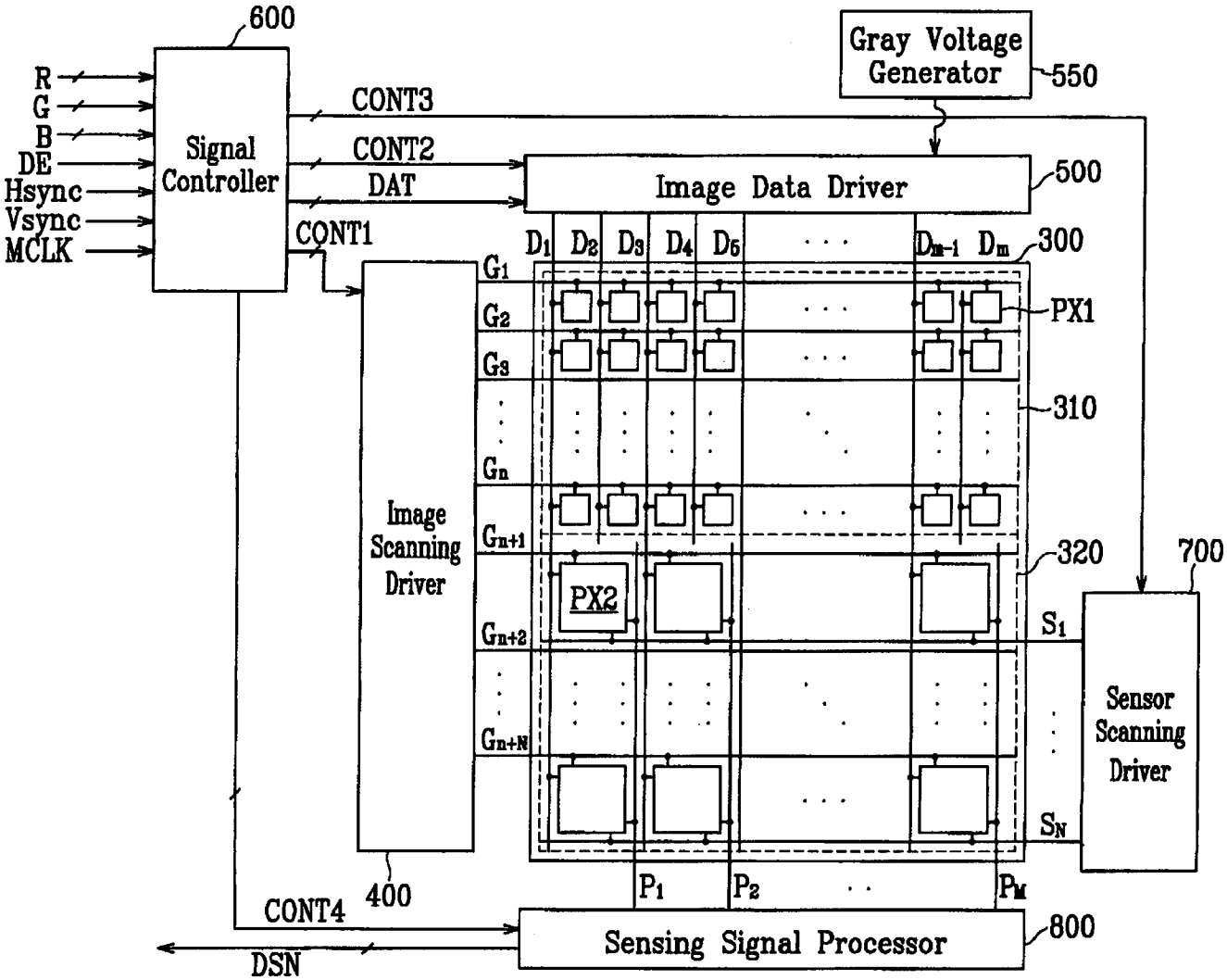
FIG. 1 is a block diagram of an LCD according to an embodiment of the present invention.

The present invention is described more fully below with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

A liquid crystal display according to an embodiment of the present invention now will be described in detail with reference to FIGS. 1, 2, 3 and 4.

Figure 2:
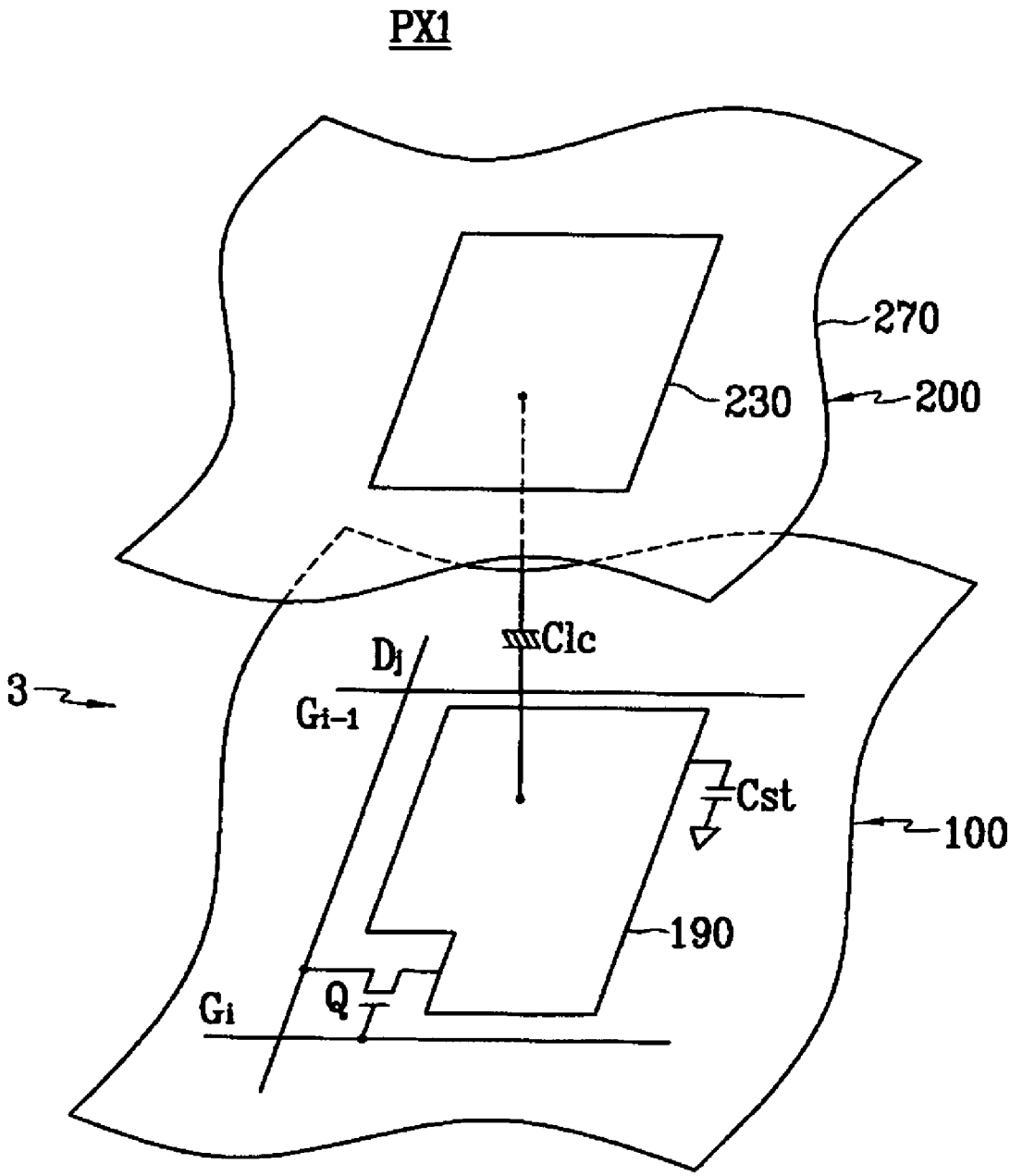
FIG. 2 is an equivalent circuit diagram of a primary pixel of an LCD according to an embodiment of the present invention.
Figure 3:
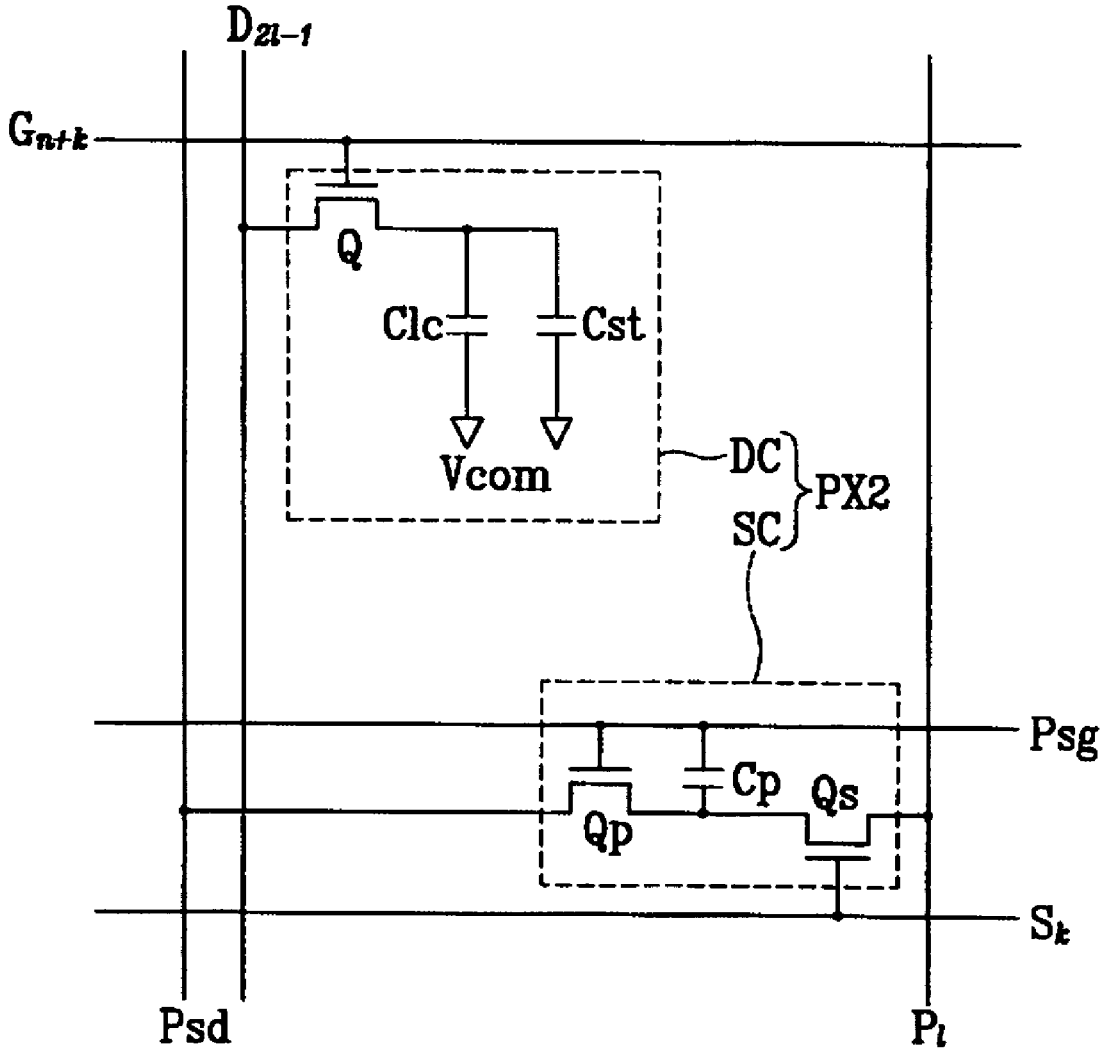
FIG. 3 is an equivalent circuit diagram of a secondary pixel of an LCD according to an embodiment of the present invention.
Figure 4:
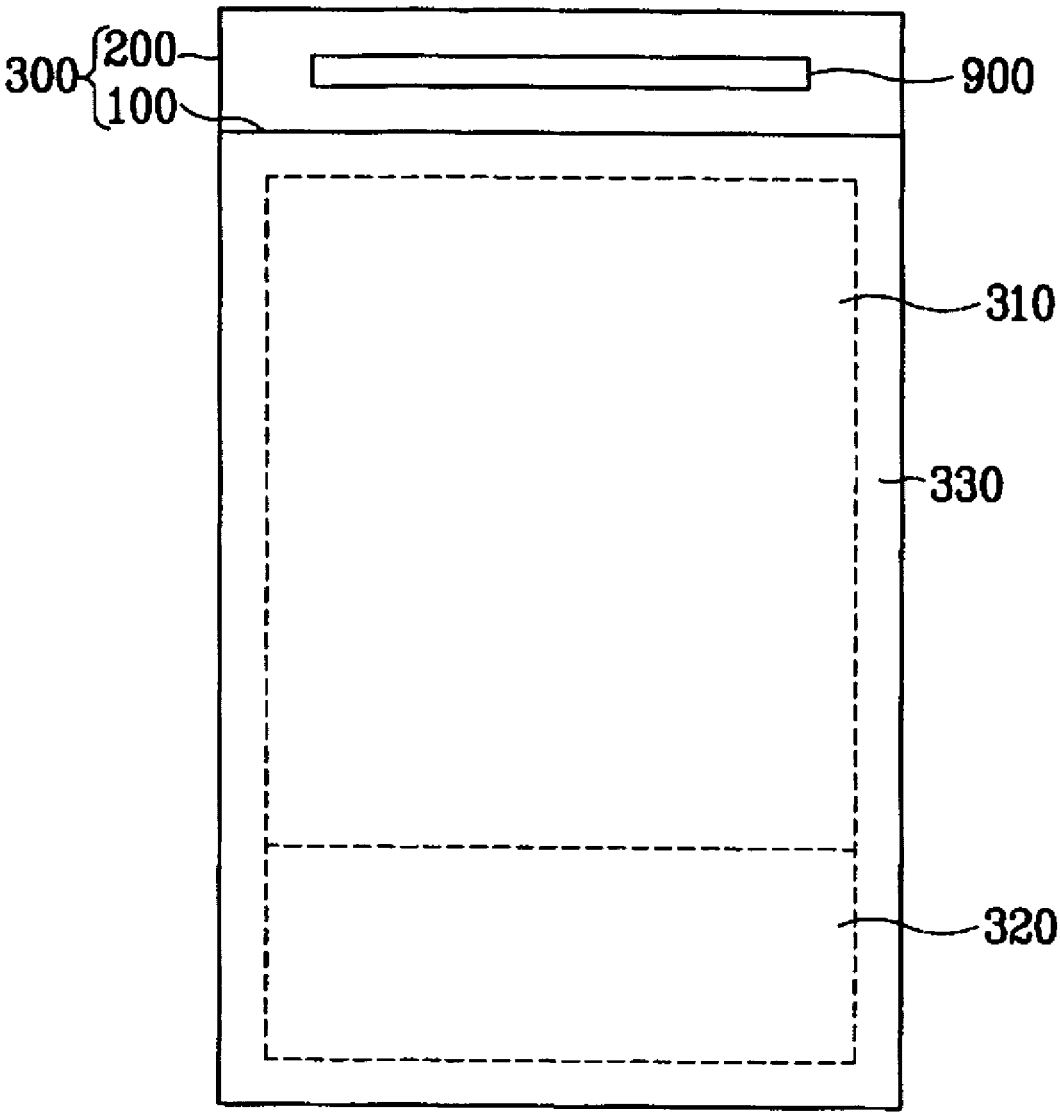
FIG. 4 is a plan view of an LC panel assembly according to an embodiment of the present invention.

FIG. 1 is a block diagram of an LCD according to an embodiment of the present invention. FIG. 2 is an equivalent circuit diagram of a primary pixel of an LCD according to an embodiment of the present invention, and FIG. 3 is an equivalent circuit diagram of a secondary pixel of an LCD according to an embodiment of the present invention. FIG. 4 is a plan view of an LC panel assembly according to an embodiment of the present invention.

Referring to FIG. 1, an LCD according to an embodiment includes a liquid crystal (LC) panel assembly 300, an image scanning driver 400, an image data driver 500, a sensor scanning driver 700, and a sensing signal processor 800 that are coupled with the panel assembly 300, a gray voltage generator 550 coupled with the image data driver 500, and a signal controller 600 controlling the above elements.

Referring to FIGS. 1 and 4, the panel assembly 300 has a primary display area 310, a secondary display area 320, and a peripheral area 330 surrounding the primary and the secondary display areas 310 and 320. Referring to FIGS. 2 and 4, the panel assembly 300 includes a lower panel 100, an upper panel 200 facing the lower panel 100, and a liquid crystal layer 3 interposed between the lower panel 100 and the second panel 200. The upper panel 200 is smaller than the lower panel 100 and exposes an area of the lower panel 100, which mounts an integrated circuit chip 900. The circuit chip 900 includes at least one of the circuit elements 400, 500, 550, 600, 700 and 800.

Panel assembly 300 includes a plurality of display signal lines $G_1$-$G_{n+N}$ and $D_1$-$D_m$, a plurality of sensor signal lines $S_1$-$S_N$, $P_1$-$P_M$, Psg and Psd, and a plurality of pixels PX1 and PX2. The pixels PX1 and PX2 are connected to the display signal lines $G_1$-$G_{n+N}$ and $D_1$-$D_m$ and the sensor signal lines $S_1$-$S_N$, $P_1$-$P_M$, Psg and Psd and arranged substantially in a matrix.

The display signal lines include a plurality of image scanning lines $G_1$-$G_{n+N}$ transmitting image scanning signals and a plurality of image data lines $D_1$-$D_m$ transmitting image data signals.

The sensor signal lines include a plurality of sensor scanning lines $S_1$-$S_N$ transmitting sensor scanning signals, a plurality of sensor data lines $P_1$-$P_M$ transmitting sensor data signals, a plurality of control voltage lines Psg, shown in FIG. 3, transmitting a sensor control voltage, and a plurality of input voltage lines Psd, shown in FIG. 3, transmitting a sensor input voltage.

The image scanning lines $G_1$-$G_{n+N}$ and the sensor scanning lines $S_1$-$S_N$ extend substantially in a row direction and are substantially parallel to each other, while the image data lines $D_1$-$D_m$ and the sensor data lines $P_1$-$P_M$ extend substantially in a column direction and are substantially parallel to each other.

Some of the image scanning lines $G_1$-$G_{n+N}$, for example, the first to the n-th image scanning lines $G_1$-$G_n$ are disposed in the primary display area 310, and the other of the image scanning lines $G_1$-$G_{n+N}$, for example, the (n+1)th to the last image scanning lines $G_{n+1}$-$G_{n+N}$ are disposed in the secondary display area 320.

Odd numbered image data lines ($D_1$, $D_3$, . . . ) extend from the primary display area 310 to the secondary display area 320, while even numbered image data lines ($D_2$, $D_4$, . . . ) are disposed only in the primary display area 310 and do not extend into the secondary display area 320. However, the number and the positions of image data lines $D_1$-$D_m$ that reach the secondary display area 320 may be varied depending on the resolution of the primary and the secondary display areas 310 and 320. The sensor signal lines $S_1$-$S_N$, $P_1$-$P_M$, Psg and Psd are disposed only in the secondary display area 320.

The pixels include primary pixels PX1 disposed in the primary display area 310 as shown in FIG. 2 and secondary pixels PX2 disposed in the secondary display area 320 as shown in FIG. 3.

Referring to FIG. 2, each of the primary pixels PX1, for example, a pixel in the i-th row (i=1, 2, . . . , n) and the j-th column (j=1, 2, . . . , m) includes a switching element Q connected to an image scanning line $G_i$ and an image data line $D_j$, and a LC capacitor Clc and a storage capacitor Cst that are connected to the switching element Q. The storage capacitor Cst may be omitted.

The switching element Q is disposed on the lower panel 100 and has three terminals, i.e., a control terminal connected to the image scanning line $G_i$, an input terminal connected to the image data line $D_j$, and an output terminal connected to the LC capacitor Clc and the storage capacitor Cst.

The LC capacitor Clc includes a pixel electrode 190 disposed on the lower panel 100 and a common electrode 270 disposed on the upper panel 200 as two terminals. The LC layer 3 disposed between the two electrodes 190 and 270 functions as dielectric of the LC capacitor Clc. The pixel electrode 190 is connected to the switching element Q, and the common electrode 270 is supplied with a common voltage Vcom and covers an entire surface of the upper panel 200. Alternatively, the common electrode 270 may be included on the lower panel 100, and at least one of the electrodes 190 and 270 may have a shape of bar or stripe.

The storage capacitor Cst is an auxiliary capacitor for the LC capacitor Clc. The storage capacitor Cst includes the pixel electrode 190 and a separate signal line, which is provided on the lower panel 100, which overlaps the pixel electrode 190 via an insulator, and is supplied with a predetermined voltage such as the common voltage Vcom. Alternatively, the storage capacitor Cst includes the pixel electrode 190 and an adjacent gate line called a previous gate line, which overlaps the pixel electrode 190 via an insulator.

For color display, each pixel uniquely represents one of primary colors (i.e., spatial division) or each pixel sequentially represents the primary colors in turn (i.e., temporal division) such that spatial or temporal sum of the primary colors are recognized as a desired color. An example of a set of the primary colors includes red, green, and blue colors. FIG. 2 shows an example of the spatial division that each pixel includes a color filter 230 representing one of the primary colors in an area of the upper panel 200 facing the pixel electrode 190. Alternatively, the color filter 230 may be provided on or under the pixel electrode 190 on the lower panel 100.

Referring to FIG. 3, each of the secondary pixels PX2, for example, secondary pixel PX2 is defined by a pair of display signal lines $G_{n+k}$ (k=1, 2, . . . , N) and $D_{21-1}$ (l=1, 2, . . . , M) and a pair of sensor signal lines $S_k$ and $P_1$. Secondary pixel PX2 also includes a display circuit DC connected to the display signal lines $G_{n+k}$ and $D_{21-1}$ and a sensing circuit SC connected to the sensor signal lines $S_k$, $P_1$, Psg and Psd. Alternatively, only a predetermined number of the secondary pixels PX2 may include the sensing circuits SC. In other words, the concentration of the sensing circuits SC may be varied and thus the number N of the sensor scanning lines $S_1$-$S_N$ and the number M of the sensor data lines $P_1$-$P_M$ may be varied.

The display circuit DC includes a switching element Q connected to an image scanning line $G_{n+k}$ and an image data line $D_{21-1}$, and a LC capacitor Clc and a storage capacitor Cst are connected to the switching element Q. The configuration of the display circuit DC is substantially the same as the primary pixel PX1 and thus the detailed description thereof will be omitted.

The sensing circuit SC shown in FIG. 3 includes a sensing element Qp connected to a control voltage line Psg and an input voltage line Psd, a sensor capacitor Cp connected to the sensing element Qp, and a switching element Qs connected to a sensor scanning line $S_k$, the sensing element Qp, and a sensor data line $P_l$.

The sensing element Qp has three terminals, i.e., a control terminal connected to the control voltage line Psg to be biased by the sensor control voltage, an input terminal connected to the input voltage line Psd to be biased by the sensor input voltage, and an output terminal connected to the switching element Qs. The sensing element Qp includes a photoelectric material that generates a current upon receipt of light. An example of the type of sensing element Qp suitable for use in practicing the present invention is a thin film transistor having an amorphous silicon or polysilicon channel that can generate current as a function of the received light. The magnitude of the sensor control voltage Psg applied to the control terminal of the sensing element Qp is sufficiently low or sufficiently high to keep the sensing element Qp in an off state without incident light. The sensor input voltage Psd applied to the input terminal of the sensing element Qp is sufficiently high or sufficiently low to keep the current flowing in a direction. The current flows toward the switching element Qs by the sensor input voltage and it also flows into the sensor capacitor Cp to charge the sensor capacitor Cp.

The sensor capacitor Cp is connected between the control terminal and the output terminal of the sensing element Qp. The sensor capacitor Cp stores electrical charge based on the output from the sensing element Qp to maintain a predetermine voltage. However, use of sensor capacitor Cp is optional.

The switching element Qs also has three terminals, i.e., a control terminal connected to the sensor scanning line $S_k$, an input terminal connected to the output terminal of the sensing element Qp, and an output terminal connected to the sensor data line $P_l$. The switching element Qs outputs a sensor output signal to the sensor data line $P_l$ in response to receipt of the sensor scanning signal from the sensor scanning line $S_k$ coupled with receipt of a sensor output current signal from the sensing element Qp. Alternatively, the sensor output signal may be a voltage stored in the sensor capacitor Cp.

The switching elements Q and Qs and the sensing element Qp may be amorphous silicon or polysilicon thin film transistors (TFTs).

The sensing circuit SC indicates a touch by an object by sensing the variation of light caused by a shadow of the object.

The sensing circuit SC may be disposed at a location displaced from the secondary pixels PX2.

One or more polarizers (not shown) are provided at the panel assembly 300.

Referring to FIG. 1 again, the gray voltage generator 550 generates two sets of gray voltages related to a transmittance of the pixels. The gray voltages in a first set have a positive polarity with respect to the common voltage Vcom, while the gray voltages in a second set have a negative polarity with respect to the common voltage Vcom.

The image scanning driver 400 is connected to the image scanning lines $G_l$-$G_{n+N}$ of the panel assembly 300 and synthesizes a gate-on voltage and a gate-off voltage to generate the image scanning signals for application to the image scanning lines $G_1$-$G_{n+N}$.

The image data driver 500 is connected to the image data lines $D_1$-$D_m$ of the panel assembly 300 and applies image data signals selected from the gray voltages to the image data lines $D_1$-$D_m$.

The sensor scanning driver 700 is connected to the sensor scanning lines $S_1$-$S_N$ of the panel assembly 320 and synthesizes a gate-on voltage and a gate-off voltage to generate the sensor scanning signals for application to the sensor scanning lines $S_1$-$S_N$.

The sensing signal processor 800 is connected to the sensor data lines $P_1$-$P_M$ of the display panel 320 and receives the sensor data signals from the sensor data lines $P_1$-$P_M$. The sensing signal processor 800 processes, for example, amplifies and filters the sensor data signals and performs an analog-to-digital conversion of the sensor data signals to generate digital sensor data signals DSN. The sensor data signals carried by the sensor data lines $P_1$-$P_M$ may be current signals and in this case, the sensing signal processor 800 converts the current signals into voltage signals before performing the analog-to-digital conversion. One sensor data signal carried by one sensor data line $P_1$-$P_M$ at a time may include one sensor output signal from one switching elements Qs or may include at least two sensor output signals outputted from at least two switching elements Qs.

The signal controller 600 controls the image scanning driver 400, the image data driver 500, the sensor scanning driver 700, and the sensing signal processor 800.

Each of the processing units 400, 500, 600, 700 and 800 may include at least one integrated circuit (IC) chip mounted on the LC panel assembly 300 or on a flexible printed circuit (FPC) film in a tape carrier package (TCP) type, which are attached to the panel assembly 300. Alternately, at least one of the processing units 400, 500, 600, 700 and 800 may be integrated into the panel assembly 300 along with the signal lines $G_1$-$G_{n+N}$, $D_1$-$D_m$, $S_1$-$S_N$, $P_1$-$P_M$, Psg and Psd, the switching elements Q and Qs, and the sensing elements Qp. Alternatively, all the processing units 400, 500, 600, 700 and 800 may be integrated into a single IC chip such as the IC chip 900 shown in FIG. 4 to reduce the occupied area and the power consumption, but at least one of the processing units 400, 500, 600, 700 and 800 or at least one circuit element in at least one of the processing units 400, 500, 600, 700 and 800 may be disposed outside of the single IC chip 900.

The operation of the above-described LCD is described in detail below.

The signal controller 600 is supplied with input image signals R, G and B and input control signals for controlling the display thereof from an external graphics controller (not shown). The input control signals include a vertical synchronization signal Vsync, a horizontal synchronization signal Hsync, a main clock MCLK, and a data enable signal DE.

On the basis of the input control signals and the input image signals R, G and B, the signal controller 600 generates image scanning control signals CONT1, image data control signals CONT2, sensor scanning control signals CONT3, and sensor data control signals CONT4, and it processes the image signals R, G and B suitable for the operation of the display panel 300. The signal controller 600 sends the scanning control signals CONT1 to the image scanning driver 400, the processed image signals DAT and the data control signals CONT2 to the image data driver 500, the sensor scanning control signals CONT3 to the sensor scanning driver 700, and the sensor data control signals CONT4 to the sensing signal processor 800.

The image scanning control signals CONT1 include an image scanning start signal STV for instructing to start image scanning and at least one clock signal for controlling the output time of the gate-on voltage Von. The image scanning control signals CONT1 may include an output enable signal OE for defining the duration of the gate-on voltage Von.

The image data control signals CONT2 include a horizontal synchronization start signal STH to start of image data transmission for a group of pixels PX, a load signal LOAD for instructing to apply the image data signals to the image data lines $D_1$-$D_m$, and a data clock signal HCLK. The image data control signal CONT2 may further include an inversion signal RVS for reversing the polarity of the image data signals (with respect to the common voltage Vcom).

Responsive to the image data control signals CONT2 from the signal controller 600, the image data driver 500 receives a packet of the digital image signals DAT for the group of pixels PX from the signal controller 600, converts the digital image signals DAT into analog image data signals, and applies the analog image data signals to the image data lines $D_1$-$D_m$.

The image scanning driver 400 applies the gate-on voltage Von to an image scanning line $G_1$-$G_{n+N}$ in response to the image scanning control signals CONT1 from the signal controller 600, thereby turning on the switching transistors Q connected thereto. The image data signals applied to the image data lines $D_1$-$D_m$ are then supplied to the display circuit DC of the pixels PX through the activated switching transistors Q.

The difference between the voltage of an image data signal and the common voltage Vcom is represented as a voltage across the LC capacitor Clc, which is referred to as a pixel voltage. The LC molecules in the LC capacitor Clc have orientations depending on the magnitude of the pixel voltage, and the molecular orientations determine the polarization of light passing through the LC layer 3. The polarizer(s) converts the light polarization into the light transmittance to display images.

By repeating this procedure by a unit of a horizontal period (also referred to as "1H" and equal to one period of the horizontal synchronization signal Hsync and the data enable signal DE), all image scanning lines $G_1$-$G_{n+N}$ are sequentially supplied with the gate-on voltage Von, thereby applying the image data signals to all pixels PX to display an image for a frame.

When the next frame starts after one frame finishes, the inversion control signal RVS applied to the image data driver 500 is controlled such that the polarity of the image data signals is reversed (which is referred to as "frame inversion"). The inversion control signal RVS may be also controlled such that the polarity of the image data signals flowing in a data line are periodically reversed during one frame (for example, row inversion and dot inversion), or the polarity of the image data signals in one packet are reversed (for example, column inversion and dot inversion).

Concurrently, the sensor scanning driver 700 applies the gate-on voltage Von to the sensor scanning lines $S_1$-$S_N$ to turn on the switching elements Qs connected thereto in response to the sensing control signals CONT3. Then, the switching elements Qs output sensor output signals to the sensor data lines $P_1$-$P_M$ to form sensor data signals, and the sensor data signals are inputted into the sensing signal processor 800.

The sensing signal processor 800 amplifies, filters, and sample-and-holds the sensor data signals and performs parallel-to-serial conversion of the sensor data signals into serial sensor data signals in response to the sensor data control signals CONT4. The sensing signal processor 800 converts the serial sensor data signals into digital sensor data signals DSN to be sent to an external device the signal controller 600. The external device appropriately processes signals from the sensing signal processor 800 to determine whether and where a touch exists. The external device may send image signals generated based on information about the touch to the LCD.

The sensing operation is performed independently of the display operation and thus the sensing operation and the display operation do not affect each other. The display operation for a pixel row may be performed in one or more horizontal periods. In addition, the display operation may be performed in one or more frames.

As described above, the primary area 310 performs only the display operation, while the secondary display area 320 performs both the display operation and the sensing operation. This configuration may be employed in various applications.

A user can do a desired work on the primary display area 310 by touching the secondary display area 320. As an example, a mouse pointer displayed in the primary display area 310 can be selected and moved by touching the secondary display area 320. As another example, letters written on the secondary display area 320 can be displayed on the primary display area 310. As another example, the secondary display area 320 act as a touch pad by matching the positions of the second display area 320 with the positions of the primary display area 310. This configuration may be also employed in a fingerprint verification technology.

Images displayed on the secondary display area 320 may not have high resolution. Therefore, the horizontal and vertical resolutions of the secondary display area 320 may be lower than those of the primary display area 310. As described above, FIG. 1 shows that the resolution of the secondary display area 320 is a half of the resolution of the primary display area.

Therefore, the primary display area 310 can display actual images, while the secondary display area 320 can display abbreviated images required for determining touch information. Furthermore, the primary display area 310 can have an increased resolution, and the interference between the image data signals and the sensor data signals may be reduced.

The touch information may be determined in consideration of the interference caused by the images displayed in the secondary display area 320 since the images displayed in the secondary display area 320 may be predetermined unlike the images displayed in the primary display area 310. Moreover, the images displayed on the secondary display area 320 can be predetermined so that the sensor data signals can be effectively generated to facilitate the determination of the touch information.

Accordingly, the embodiment of the present invention can reduce the disturbance exerted on the sensing circuits and the sensing signal lines to facilitate the determination of the touch information.

The improvement in the sensing operation can eliminate the requirement of other types of sensing circuits that sense physical quantities, such as pressure resulting from a touch, in addition to light variation.

An LCD according to another embodiment of the present invention is described below in detail with reference to FIG. 5.

Figure 5:
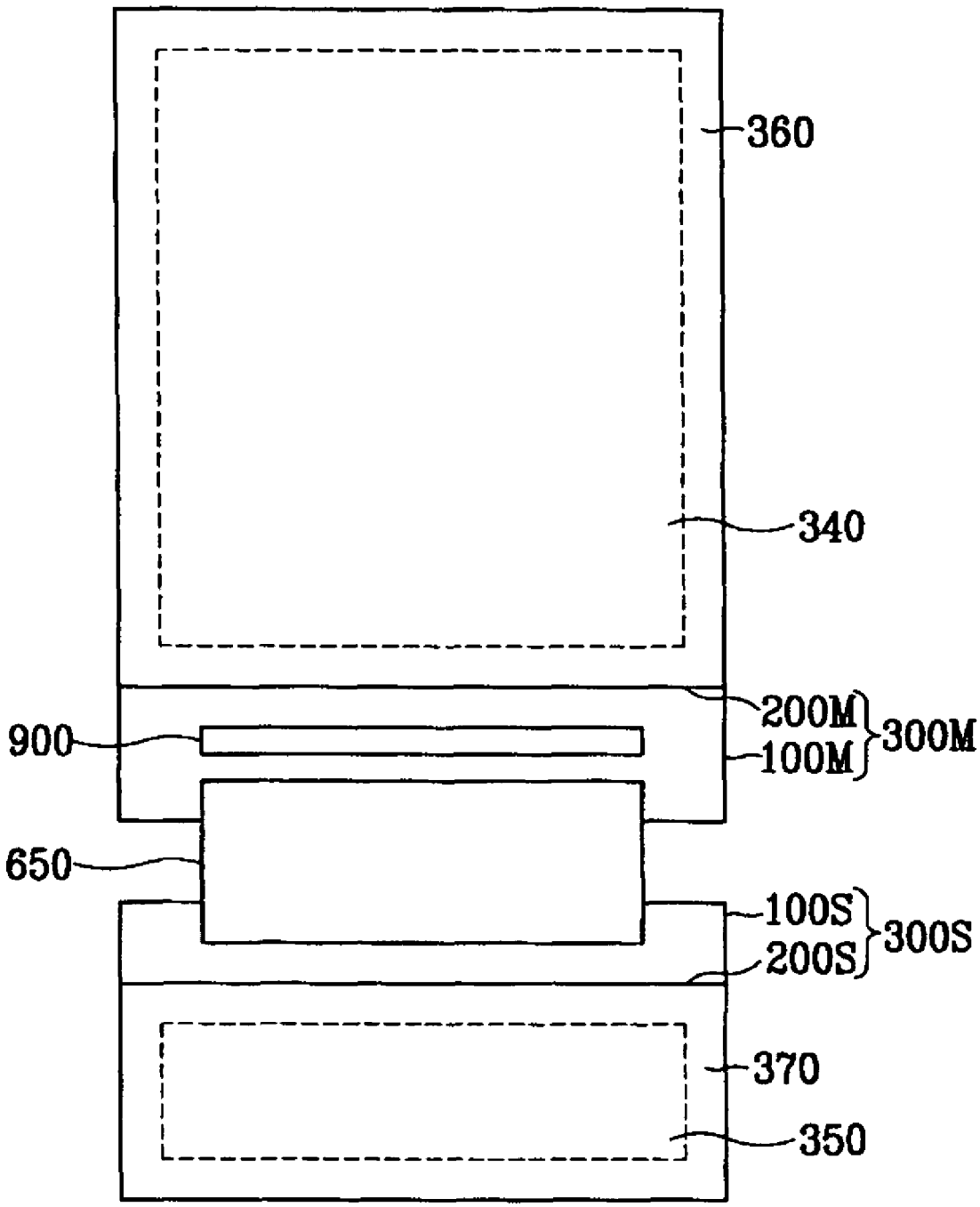
FIG. 5 is a block diagram of a touch sensible LCD according to another embodiment of the present invention.

FIG. 5 is a schematic diagram of a touch sensing LCD according to another embodiment of the present invention.

Referring to FIG. 5, a touch sensing LCD according to another embodiment of the present invention includes a primary panel unit 300M, a secondary panel unit 300S, a connecting member 650, and an IC chip 900.

The primary panel unit 300M includes a lower panel 100M and an upper panel 200M, and the primary panel unit 300M is divided into a display area 340 and a peripheral area 360. The primary display area 340 is provided with image scanning lines (not shown), image data lines (not shown), and primary pixels (not shown) connected to the image scanning lines and the image data lines.

The secondary panel unit 300S also includes a lower panel 100S and an upper panel 200S, and the secondary panel unit 300S is divided into a display area 350 and a peripheral area 370. The display area 350 of the secondary panel unit 300S is provided with image scanning lines (not shown), image data lines (not shown), sensing scanning lines (not shown), sensing data lines (not shown), and secondary pixels (not shown) connected to the scanning lines and the data lines. The secondary pixels include display circuits and sensing circuits. However, the display circuits and the sensing circuits may be disposed independent from each other.

Comparing the LCD shown in FIG. 5 with the LCD shown in FIGS. 1-4, the panel assembly 300 shown in FIG. 1 is divided into two panel units 300M and 300S. However, the features of the panel assembly 300 shown in FIGS. 1-4 can be also applied to the panel units 300M and 300S and the detailed description thereof will be omitted.

The IC 900 is mounted on an exposed area of the lower panel 100M of the primary panel unit 300M, and the connecting member 650 is attached to exposed portions of the lower panels 100M and 100S of the primary and the secondary panel units 300M and 300S. The connecting member 650 may include a flexible printed circuit (FPC) film provided with a plurality of conductive lines for electrically connecting the primary panel unit 300M and the secondary panel unit 300S. The IC 900 may be mounted on the connecting member 650.

The IC 900 outputs control signals and image data signals to the primary panel unit 300M and to the secondary panel unit 300S through the connecting member 650. In addition, the IC 900 receives sensor data signals from the secondary panel unit 300S through the connecting member 650.

The divisional configuration of the primary panel unit 300M and the secondary panel unit 300S may conveniently be employed for use in a folding device such as a mobile phone.

The above-described embodiments can be also applied to any of display devices such as organic light emitting diode display, and a field emission display.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention as defined in the appended claims.

What is claimed is:

1. A display device comprising a display panel having a first display area and a second display area, wherein the display panel comprises:

a plurality of first display circuits disposed in the first display area;

a plurality of second display circuits disposed in the second display area;

a plurality of touch sensing circuits disposed in the second display area, wherein a display resolution of the second display is lower than a display resolution of the first display;

a plurality of first image scanning lines disposed in the first display area;

a plurality of second image scanning lines disposed in the second display area;

a plurality of first image data lines disposed in the first display area; and a plurality of second image data lines disposed in the second display area, wherein the first display circuits are connected to the first image scanning lines and the first image data lines, and the second display circuits are connected to the second image scanning lines and the second image data lines, and wherein the second image data lines extend from part of the first image data lines.

2. The display device of claim 1, wherein the display panel further comprises:

a plurality of sensor scanning lines disposed in the second display area; and a plurality of sensor data lines disposed in the second display area, wherein the sensing circuits are connected to the sensor scanning lines and the sensor data lines.

3. The display device of claim 1, wherein the first display area comprises:

a first panel unit; and the second display area comprises a second panel unit, and further wherein the second panel unit is physically separated from the first panel unit.

4. The display device of claim 3, further comprising a connecting member connecting the first panel unit and the second panel unit.

5. The display device of claim 4, wherein the connecting member comprises a plurality of electrically conductive lines providing electrical connection between the first panel unit and the second panel unit.

6. The display device of claim 5, wherein the connecting member comprises a flexible printed circuit film.

7. The display device of claim 1, wherein a resolution of the second display circuits is different than a resolution of the photo sensing circuits.

8. The display device of claim 1, wherein each of the sensing circuits forms a pixel along with one of the second display circuits.

9. The display device of claim 1, wherein the touch sensing circuits comprise photo sensing circuits generating sensor output signals based on an amount of ambient light, and the second image data lines carry sensor data signals originated from the sensor output signals.

10. The display device of claim 9, wherein each of the photo sensing circuits comprises:

a sensing element generating current having a magnitude which is a function of the amount of light received by the sensing element; and a switching element coupled to the sensing element, the switching element selectively outputting the sensor output signals based on the current.

11. The display device of claim 10, wherein each of the photo sensing circuits further comprises a capacitor storing the current.

12. The display device of claim 10, further comprising:

an image data driver converting image signals into image data signals and applying the image data signals to the first and the second image data lines;

a sensing signal processor processing the sensor data signals supplied from the sensor data lines to generate digital sensor data signals; and a signal controller controlling the image data driver and the sensing signal processor.

13. The display device of claim 12, wherein the image data driver, the sensing signal processor, and the signal controller are integrated into a single integrated circuit chip.

14. The display device of claim 12, further comprising:

an image scanning driver applying image scanning signals to the image scanning lines; and a sensor scanning driver applying sensor scanning signals to the sensor lines.

* * * * *